United States Patent [19]

Oyama et al.

[11] Patent Number: 4,884,049

[45] Date of Patent: Nov. 28, 1989

[54] CIRCUIT BREAKER OVERCURRENT TRIPPING DEVICE

[75] Inventors: Jun Oyama; Naoshi Uchida, both of Kanagawa, Japan

[73] Assignee: Fuji Electric Co., Ltd., Kanagawa, Japan

[21] Appl. No.: 270,334

[22] Filed: Nov. 14, 1988

[30] Foreign Application Priority Data

Dec. 29, 1987 [JP] Japan ..... 335383

[51] Int. Cl.[4] ..... H01H 75/08; H01H 75/12

[52] U.S. Cl. ..... 337/36; 337/41; 337/43

[58] Field of Search ..... 335/36–43

[56] References Cited

U.S. PATENT DOCUMENTS 3,005,066 10/1961 Powell ..... 335/43

3,179,767 4/1965 Middendorf ..... 335/36

*Primary Examiner*—H. Broome

*Attorney, Agent, or Firm*—Finnegan,Henderson, Farabow, Garrett and Dunner

[57] ABSTRACT

There is disclosed a circuit breaker overcurrent tripping device. This tripping device includes: a fixed iron core accommodating a bimetallic strip in which a flow of an electric current is present, the bimetallic strip bending when an overcurrent is present; a movable iron core attracted to the fixed iron core when the electric current becomes a short circuit accident current; a tripping mechanism operated both by the movement of the movable iron core or the bending of the bimetallic strip; a fixed contact point connected via a connecting wire to a load terminal; a movable contact point fixed to the movable iron core and connected via a conductor wire to a fixed end of the bimetallic strip; and a flexible conductor for connecting a free end of the bimetallic strip to the load terminal. In this configuration, the fixed iron core is wound with at least one turn of the flexible conductor, thereby increasing the magnetic force attracting the movable iron core to the fixed iron core. A shunt circuit is formed when the movable iron core contacts the fixed iron core, thereby reducing the current overload on the bimetallic strip, and preventing the bimetallic strip from damage.

1 Claim, 2 Drawing Sheets

CIRCUIT BREAKER OVERCURRENT TRIPPING DEVICE

BACKGROUND OF THE INVENTION

1. Field of the Invention:

The present invention generally relates to a circuit breaker overcurrent tripping device, and more particularly, to a thermal electromagnetic type overcurrent tripping device.

2. Description of the Prior Art:

An overcurrent tripping device for use with a small-sized circuit breaker, with a rated current for example of 30 A or less, is typically classified as one of two types. The first is a thermal electromagnetic type, in which an electric current flowing through the breaker is designed to flow directly in a bimetallic strip. An electromagnet is activated by a large electric current associated with a short-circuit flowing in the bimetallic strip, tripping the breaker at a set current rating. Another type is a complete electromagnetic type, in which an electromagnet is used in combination with an oil dash-pot. The complicated structure of the complete electromagnetic type makes it very expensive. Further, it is difficult to prevent leakage of oil from the dash-pot. As a result, there is very little demand for the complete electromagnetic type overcurrent tripping device.

Well-known examples of the thermal electromagnetic type overcurrent tripping device are given in FIGS. 3 and 4, wherein a shunt circuit is provided in parallel with the bimetallic strip. Referring first to FIG. 3, an insulating casing 1 and an insulating cover 2 enclose: a contact unit 20, an overcurrent tripping device 40 connected through a flexible conductor 3 and a connecting conductor 4 to contact unit 20, and an opening/closing mechanism 50 connected to contact unit 20 to open and close unit 20. The opening/closing mechanism 50 engages the overcurrent tripping device 40. A power source terminal 5 is connected to the contact unit 20, while a load terminal 6 is connected to the overcurrent tripping device 40. Contact unit 20 is comprised of the following elements: a fixed contact 12 having one end from which the power source terminal 5 is extended and another end to which a fixed contact point 11 is attached; a movable contact 14 having one end to which a movable contact point 13 is fixed and another end connected to the flexible conductor 3; a movable contact support 15 having one end pin-connected to a mid-portion of the movable contact 14 and another end fixed to a cross bar 7 through which the poles communicate with each other; a contact spring 16 stretching between the movable contact support 15 and the movable contact 14, for imparting an impinging pressure between the movable contact point 13 and the fixed contact point 11; and an arc extinction chamber 17 surrounding a contact parting region of the fixed and movable contact points 11 and 13. The overcurrent tripping device 40 is comprised of the following elements: a fixed end connected to the connecting conductor 4 and a free end connected through the flexible conductor 21 to the load terminal 6; a fixed iron core 23 disposed to encompass a bimetallic strip 22, the iron core 23 assuming a substantially C-shape in which one side is open; a movable iron core 25, pivotally supported on the side of the opening of the fixed iron core 23, from which a return spring 24 extends to the fixed iron core 23; an engagement screw 26 so engaged at the free end of the bimetallic strip 22 as to be advanceable and retractable; a tripping lever 27 extended to the movable iron core 25; and a tripping mechanism 30 composed of a tripping lever 28 so disposed as to be capable of engaging with the tip of the tripping lever 27 and a latch receiver 29. The opening/closing mechanism 50 is formed chiefly of a toggle link 42 having one end connected by a pin to the movable contact support 15 and the other end connected by a pin to a latch 41 engaging with the latch receiver 29; a handle lever 44 including its pivotally supported head portion into which an operation handle 43 protruding from a window 2a formed in the cover 2 is embedded; and an opening/closing spring 46 stretching between an articulating pin 45 of the toggle link 42 and the handle lever 43.

Based on this construction, the overcurrent tripping device 40 functions in the following manner. When a current slowly approaching the overcurrent rating flows in the bimetallic strip 22 connected in series to the contact unit 20, the resistance of the bimetallic strip 22 generates Joule heat in the bimetallic strip 22. As a result, the free end of the bimetallic strip 22 is bent counter-clockwise, whereby the tip of the engagement screw 26 causes the tripping lever 28 of the tripping mechanism 30 to rotate counter-clockwise. Then, the engagement of the latch 41 of the opening/closing mechanism 50 with the latch receiver 29 is released, and the toggle link 42 is shifted, thereby causing the contact unit 20 to effect the breaking operation. If a large short circuit accident current flows in the contact unit 20 and the bimetallic strip 22, the bimetallic strip again emits the heat and is bent. In advance of this process, however, a magnetic flux generated in the fixed iron core 23 attracts the movable iron core 25, overcoming a spring force of the return spring 24. As in the case of the slowly increasing overcurrent, the tip of the tripping lever 27 causes the contact unit 20 to effect the breaking operation through the tripping mechanism 30 and the opening/closing mechanism 50.

FIG. 4 depicts another prior art device. In FIG. 4, a shunt circuit is provided consisting of a connecting wire 33 and a contact point unit consisting of a movable contact point 31 and a fixed contact point 32 in parallel with a circuit formed of the bimetallic strip between the connecting plate 4 and the load terminal 6. Note that the movable contact point 31 is fixed to the movable iron core 25, while the fixed contact point 32 is fixed to the fixed iron core 23. The movable contact point 31 is connected through the flexible conductor 34 to the connecting plate 4. In this device, the short circuit accident current is shunted, and the electric current passing through the bimetallic strip 22 is reduced.

In the above-described prior art device, however, if a large short circuit accident current flows as in FIG. 3, an amount of heat generated in the bimetallic strip 22 may exceed an allowable range, and the bimetallic strip 22 can be deformed or melted before performing the breaking process. In the example shown in FIG. 4, if an overcurrent flows in the bimetallic strip 22, the fixed iron core 23 is magnetized by the magnetic flux generated by the electric current, and the movable iron core 25 is attracted into contact with the fixed iron core. Thus, the above-mentioned shunt circuit is formed. However, the generated magnetic flux is frequently too small to attract the movable iron core 25 quickly enough. In the case of the short circuit accident current, the large current flows in the bimetallic strip before the shunt circuit can be formed, so that the bimetallic strip 22 can be deformed or melted, preventing the breaking operation from occurring.

SUMMARY OF THE INVENTION

It is a primary object of the present invention to avoid the above-described defects by providing a direct heating thermal electromagnetic type circuit breaker overcurrent tripping device, of simple structure, small size, and capable of successful operation in all short circuit overcurrent situations.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects according to the purpose of the invention as broadly described herein, there is provided a circuit breaker overcurrent tripping device comprising a fixed iron core disposed to accommodate a bimetallic strip, the fixed iron core having one end being formed open; a bimetallic strip conducting an electric current and configured to bend when an overcurrent is present; a movable iron core pivotally supported adjacent the open side of the fixed iron core and attracted to the fixed iron core while overcoming a return spring when the electric current becomes an accident current; a tripping mechanism operated when the movable iron core is attracted and when the bimetallic strip is bent; a fixed contact point adjacent the open side of the fixed iron core and connected through a connecting wire to a load terminal; a movable contact point fixed to the movable iron core for impinging on the fixed contact point when the movable iron core is attracted to the fixed iron core, and further connected to a fixed end of the bimetallic strip; and a flexible conductor for connecting a free end of the bimetallic strip to the load terminal, characterized by winding the fixed iron core with at least one turn of the flexible conductor, in order to increase the magnetic field of the fixed iron core.

In the overcurrent tripping device according to the present invention, the fixed iron core is wound with at least one turn of the flexible conductor for connecting the free end of the bimetallic strip to the load terminal. In this arrangement, the magnetic force generated by the fixed iron core increases when a large short circuit accident current flows in the bimetallic strip, attracting the movable iron core into contact to form a shunt circuit.

BRIEF DESCRIPTION OF THE DRAWINGS:

The accompanying drawings, which are incorporated in and constitute a part of the specification, illustrate a preferred embodiment of the invention and, together with the general description given above and detailed description of the preferred embodiment given below, serve to explain the principles of the invention.

DETAILED DESCRIPTION OF THE PREFERRED EMBODIMENT:

Reference will now be made in detail to the present preferred embodiment of the invention as illustrated in the accompanying drawings.

Figure 1:
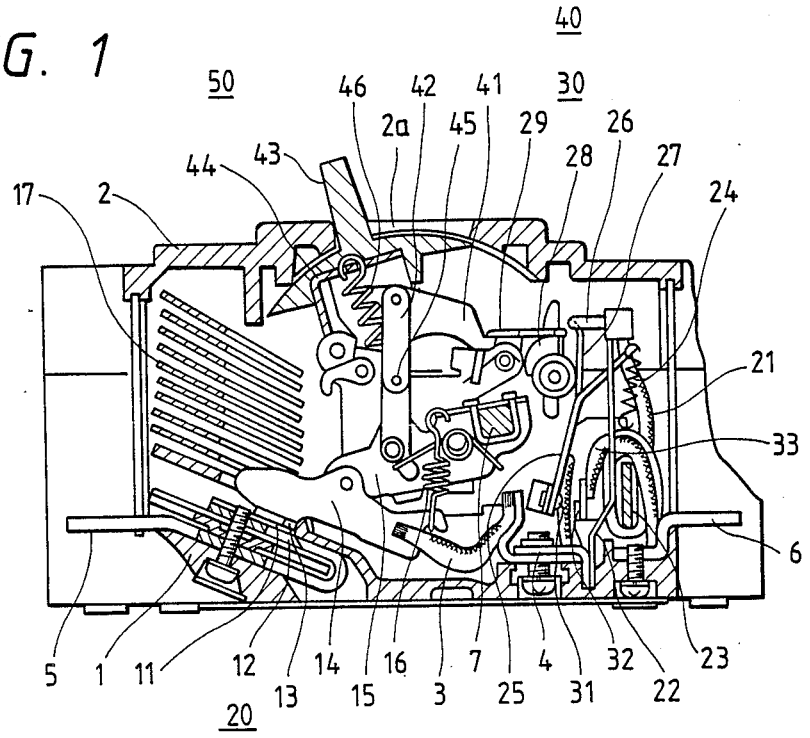
FIG. 1 is a vertical sectional view illustrating a circuit breaker in its entirety, including the overcurrent tripping device of the present invention.
Figure 2:
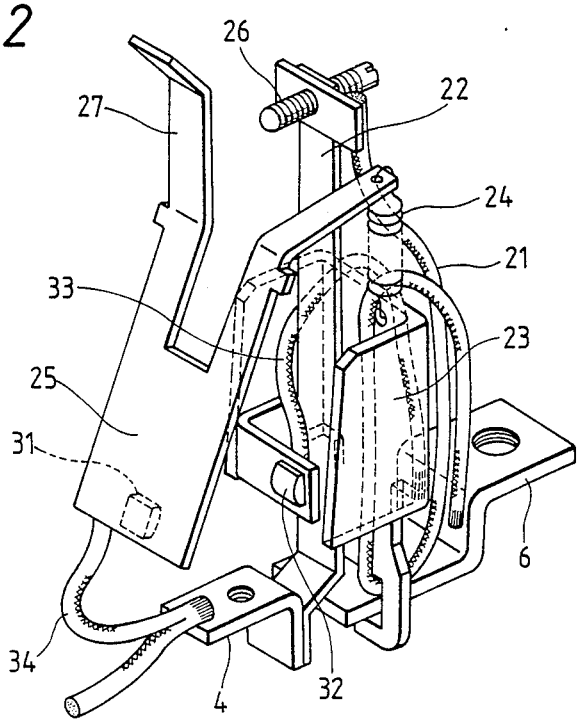
FIG. 2 is an enlarged perspective view illustrating an overcurrent tripping device of the present invention.
Figure 3:
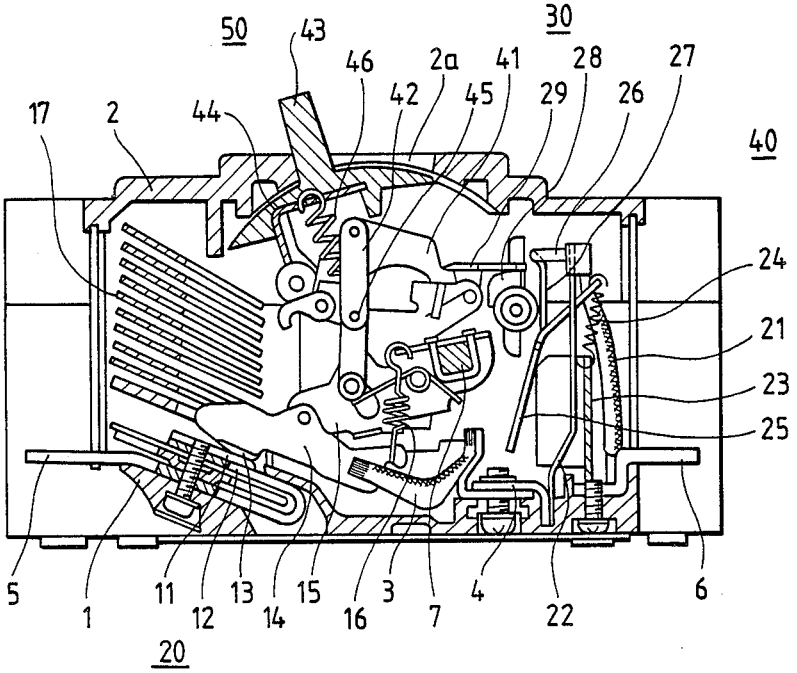
FIG. 3 PRIOR ART
FIG. 3 is a vertical sectional view illustrating a circuit breaker in the entirety, including a prior art overcurrent tripping device.
Figure 4:
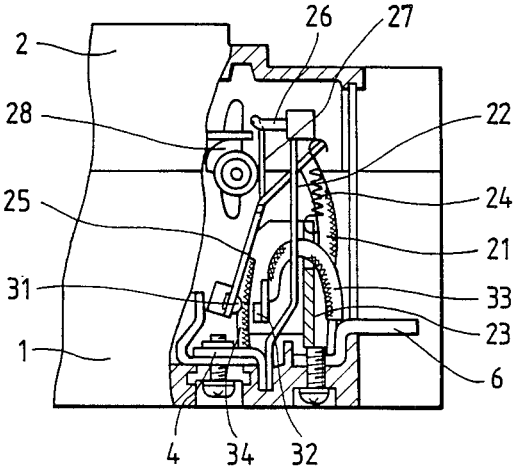
FIG. 4 PRIOR ART
FIG. 4 is an enlarged vertical sectional view illustrating a prior art overcurrent tripping device.

FIGS. 1 and 2 show one embodiment of a circuit breaker with an overcurrent tripping device of the present invention. FIG. 1 is a vertical sectional view of an entire circuit breaker. FIG. 2 is an enlarged perspective view depicting the overcurrent tripping device. In FIGS. 1 and 2, the same components as those shown in FIGS. 3 and 4 (representing the prior art) serve the same functions and are marked with like symbols. The following description is therefore focused on the different points between the present invention and the prior art device. The difference between the overcurrent tripping device in the present embodiment and the prior art device is as follows: In FIG. 2, a fixed iron core 23 is wound with a plurality of turns of a flexible conductor 21 for connecting a free end of a bimetallic strip 22 to a load terminal 6. A movable contact point 31 is fixed to a movable iron core 25 and connected through a flexible conductor 34 to a connecting conductor 4. A fixed contact point 32 is attached to the fixed iron core 23.

On the basis of this configuration, when contact unit 20 is shut, as depicted in FIG. 1, the electric current flows in the following path: power source terminal 5, to contact unit 20, through flexible conductor 3, to connecting conductor 4, to bimetallic strip 22, through flexible conductor 21, to load terminal 6. When the electric current increases, as in the case of a short circuit accident current, the fixed iron core 23 strongly attracts the movable iron core 25 due to a powerful magnetic flux generated by the current flowing in the turns of the flexible conductor 21 wound round the fixed iron core. As the current increases through the turns the magnetic attracting force grows, thereby accelerating the motion of the movable iron core 25. As in the prior art, the motion of movable iron core 25 moves the tip of the tripping lever 27, causing contact unit 20 to effect the breaking operation through tripping mechanism 30 and opening/closing mechanism 50.

The embodiment shown in FIG. 2 depicts a fixed iron core 23 wound with nearly one turn of a connecting wire 33. However, the fixed iron core 23 may also be wound with at least one turn of the connecting wire 33 in order to compensate for a drop in the magnetic attracting force concurrent with a decrease in current flow after closing the shunt circuit. The size of the accident current flowing in the bimetallic strip 22 and the time the current flows therein are reduced, thereby reducing the risk of damage to the bimetallic strip.

As discussed above, the fixed iron core is wound with at least one turn of the flexible conductor for connecting the free end of the bimetallic strip to the load terminal. It is therefore possible to provide a circuit breaker overcurrent tripping device which can be applied to an electric path having a large short-circuit capacity with a small rated current, without increasing the size of the device or increasing the complexity of the design.

Although the preferred embodiment of the present invention has been described in greater detail with reference to the accompanying drawings, it is to be understood that the invention is not limited to the precise embodiment. Various changes or modifications may be effected therein by one skilled in the art without departing from the scope or the spirit of the invention.

What is claimed is:

1. A circuit breaker overcurrent tripping device, comprising:

a bimetallic strip for conducting an electric current and configured to bend in response to a predetermined accidental increase in the electric current;

a fixed iron core having an open side, disposed and configured to accommodate the bimetallic strip;

a movable iron core pivotally supported adjacent the open side of said fixed iron core and magnetically attracted to said fixed iron core in response to the accidental increase of electric current;

a tripping mechanism responsive to the movement of said movable iron core toward said fixed iron core and the bending of said bimetallic strip;

a fixed contact point disposed adjacent the open side of said fixed iron core and electrically connected through a connecting wire to a load terminal;

a movable contact point fixed to said movable iron core for impinging on said fixed contact point, said movable contact point being further connected via a conductor wire to a fixed end of said bimetallic strip; and means for increasing a magnetic field of the iron core in response to said accidental increase of electric current, said means including a flexible conductor wound at least once around said fixed iron core and electrically connected at opposite ends to a free end of said bimetallic strip and said load terminal.

* * * * *